US006022145A

United States Patent [19]

Searfoss

[11] Patent Number: 6,022,145

[45] Date of Patent: Feb. 8, 2000

[54] CONTAINER CLOSURE DEVICE

[76] Inventor: Robert Searfoss, 1370-3 Chalmette Dr., NE., Atlanta, Ga. 30306

[21] Appl. No.: 09/161,927

[22] Filed: Sep. 28, 1998

[51] Int. Cl.[7] ..... B65D 33/24

[52] U.S. Cl. ..... 383/66; 24/30.5 R; 383/202

[58] Field of Search ..... 383/66, 202; 229/204, 229/122, 125.15, 125.08; 24/30.5 R; 222/541.5, 528, 533

[56] References Cited

U.S. PATENT DOCUMENTS

| | | | |
|---|---|---|---|
| 3,711,011 | 1/1973 | Kugler | 383/211 |
| 4,185,754 | 1/1980 | Julius | 383/211 |
| 4,830,273 | 5/1989 | Kalberer et al. | 229/125.15 |
| 4,863,064 | 9/1989 | Dailey, III | 206/494 |
| 4,946,040 | 8/1990 | Ipenburg | 383/202 |
| 5,067,614 | 11/1991 | Jonsson | 229/125.08 |
| 5,080,263 | 1/1992 | Johnson | 383/202 |

*Primary Examiner*—Stephen P. Garbe
*Attorney, Agent, or Firm*—Drummond & Duckworth

[57] ABSTRACT

The container closure device for attachment to a container includes a substantially planar sidewall segment having a front surface, rear surface and plurality of sides. Formed through the sidewall segment from the front surface to the rear surface is an orifice for permitting the contents of a container to pass through. The container closure device further includes a flap which extends from the top of the sidewall segment by means of a hinge or the like. The hinge permits the flap to fold upwardly to keep the orifice unobstructed, or fold downwardly to cover and obstruct the orifice. The container closure device is attached to a container by an adhesive means.

3 Claims, 1 Drawing Sheet

CONTAINER CLOSURE DEVICE

BACKGROUND OF THE INVENTION

The present invention relates to containers and container closure devices. More particularly, the present invention relates to reclosable container closure devices which selectively dispense materials packaged within a container.

Products for sale to a consumer must be packaged so that the product is closed from the atmosphere. This is particularly true for hydrophilic products such as dry dog food, cat litter, bird seed, laundry detergent, planters soil, snack food products, etc. For pourable products, such as a granular or powder material, it is desirable that the packaging be provided with a structure for conveniently dispensing the material. It is also desirable that the packaging be capable of being reclosed after use.

Containers are known for packaging and selling various products. For example, plastic bag containers are generally sleeve-like four-sided devices made from sheets of plastic which are sealed along their edges. Examples of plastic bag containers which are typically reenforced by cardboard or paper, are containers for the sale of pet food, such as dry dog food, bird seed, etc. Unfortunately, once opened, these devices do not include a means incorporated into the bag for maintaining the bag in a closed configuration which leaves the container susceptible to spilling and the contents of the container open to the atmosphere. To overcome these disadvantages, consumers typically use a clip or the like to press open the edges of the bag together. Otherwise, the bag is left open with contents of the bag in contact with the atmosphere.

Several attempts have been made to produce a container including a device for dispensing the material within the container. For example, U.S. Pat. No. 5,160,308 issued to Peppiatt discloses a flexible bag having a pouring spout. The bag assumes a roughly hexahedral shape. When the bag is filled, a pouring conduit extends from both sides of the bag and acts as a spout permitting the contents of the bag to be easily poured.

Meanwhile, U.S. Pat. No. 3,567,073 issued to Friedenthal discloses a dispensing container with a rupturable spout. The container includes a breakaway section separated by a line of weakness. To gain access to the contents of the bag, the breakaway section is removed and then covered with a flap having a pouring hole. U.S. Pat. No. 5,133,497 issued to K üppersbusch discloses a similar container for packaging milk in which a top flap forms an ear which is folded down to cover an aperture formed in the sidewall of the container.

Moreover, U.S. Pat. No. 4,231,326 issued to Hager discloses a dog food container formed from a single precut-perforated cardboard blank. The dog food container is transformed by the consumer to provide a hopper and tray into which dog food can be released into.

All of the above described containers suffer from serious drawbacks. For example, each of these containers is relatively complicated and expensive to manufacture or assemble. Furthermore, several of these containers do not provide an adequate seal for the container. For example, the dog food container of U.S. Pat. No. 4,231,326 permits to the contents within the container to be entirely open to the atmosphere, potentially spoiling the contents of the bag. Furthermore, U.S. Pat. Nos. 5,160,308 and 3,567,073 require that the container be tilted to permit the contents within the container to be released.

It is therefore an object of the invention to provide an improved container closure device for selectively releasing the contents within the package.

It is an additional object of the invention that the container closure device of the present invention be inexpensive and uncomplicated to manufacture.

It is still another object of the present invention that the container closure device be capable of functioning with a variety of different containers of different configurations and materials.

Additionally, it is an object of the present invention that the container closure device provide a useful means for both commencing the dispencement of a material from the interior of the container and for efficiently terminating the flow of the contents from the a container when so desired.

It is a still further object of the present invention to provide a reclosable container closure device which may be located at the lower portion of the container to permit gravity to release the container contents in contrast to tilting the container required for releasing the container contents from the top portion of the container.

SUMMARY OF THE INVENTION

Briefly, in accordance with the invention, I provide an improved reclosable container closure device. The container closure device is capable of being integrated to the container by the manufacturer. Furthermore, the container closure device of the present invention can also be attached to a container by a distributor prior to purchase by a consumer. Moreover, the container closure device of the present invention may also be attached to a container by a consumer who wishes to provide a previously purchased container with a reclosable container closure device.

My container closure device includes a substantially planar sidewall segment having a front surface and a rear surface. The planar sidewall segment includes a plurality of sides. Depending on the number of sides, the sidewall segment may be of virtually any shape. For example, a sidewall segment having three sides would thus be triangular in shape. Similarly, a sidewall segment having four sides would typically be substantially rectangular in shape. The sidewall segment of the container closure device further includes an orifice projecting from the sidewall segment's front surface to its rear surface to permit the passage of gaseous, liquidous or solid material to pass through. The container closure device further includes a flap extending from one of the sides of the sidewall segment. Though the flap may extend from any side of the orifice, in a preferred embodiment the flap extends from the uppermost side of the sidewall segment and folds over the sidewall segment's front surface to substantially cover the sidewall segment's orifice. Coverage of the orifice by the flap thereby obstructs the passage of material through the orifice. Moreover, the flap is attached to the sidewall segment by means of a hinge or the like permitting the flap to both fold downwardly over the front surface and orifice to obstruct the orifice, and fold upwardly to keep the orifice uncovered and unobstructed. Extending from the flap is a tab section which is adapted to be capable of being forced within the sidewall segment's orifice and then locked in place upon engaging the sidewall segment's rear surface.

Finally, the container closure device of the present invention further includes an attachment means for attaching the sidewall segment's rear surface to a container. The attachment means may be an adhesive or any of several means known to those skilled in the art for attaching two devices together. In a preferred embodiment, the attachment means is an adhesive covered by a paper or plastic cover which is removable by simply peeling the cover from the adhesive.

This embodiment permits a consumer to readily and easily remove the peelable cover for attachment of the attachment means to any container selected by the consumer. In an additional preferred embodiment, the attachment means is a dry adhesive which adheres when moistened. This embodiment also readily and easily permits a consumer to supplement a container with the closure device of the present invention by simply moistening the adhesive and attaching the sidewall segment of the closure device to the container.

Accordingly, it is a principal object of the invention to provide an improved reclosable container closure device for packaging which may be attached by the manufacturer, the distributor, or the ultimate consumer. It is another object of the invention to provide a container closure device which is inexpensive to manufacture.

It is still another object of the invention to provide a container closure device which can be attached at the bottom portion of a container permitting gravity to expel the container's contents without the need of tipping or lifting the container.

These and other, further and more specific objects and advantages of the invention will be apparent to those skilled in the art from the following detailed description taken in conjunction with the drawings.

DETAILED DESCRIPTION OF THE PREFERRED EMBODIMENTS

Figure 1:
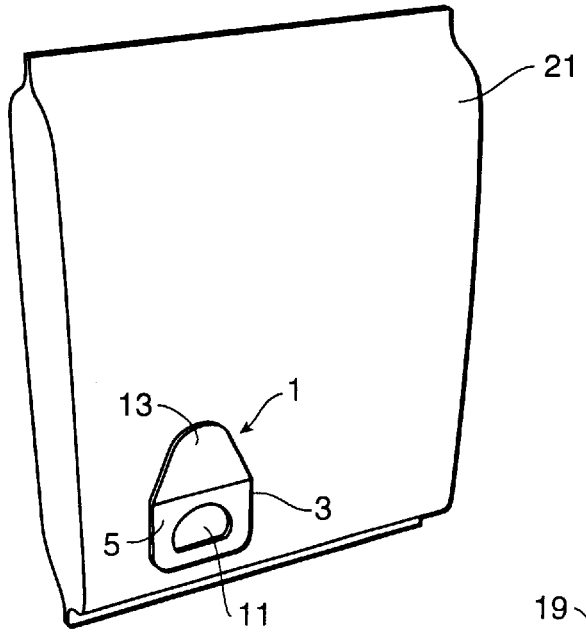
FIG. 1 is a perspective view of a container including a container closure device of the present invention.

While the present invention is susceptible of embodiment in various forms, as shown in the drawings, hereinafter will be described the presently preferred embodiments of the invention with the understanding that the present disclosure is to be considered as an exemplification of the invention and is not intended to limit the invention to the specific embodiments.

Referring to the figures, the reclosable container closure device 1 of the present invention includes a substantially planar sidewall segment 3 having a front surface 5, rear surface 7 and a plurality of sides 9. Projecting through the sidewall segment from the front surface 5 to the rear surface 7 is an orifice 11. The orifice 11 is sufficiently large to permit the contents of a container to pass through. The container closure device of the present invention further includes a flap 13. In a preferred embodiment, the flap 13 extends from the uppermost side 9 of the sidewall segment and is hinged as to be capable of folding over the sidewall segment's front surface to substantially cover the sidewall segment's orifice 11. Without deviating from the scope of the present invention, the flap 13 may also extend from the sidewall segment to the left or right of the orifice 11 and may also be constructed to extend from the bottom side of the sidewall segment and constructed to fold over the sidewall segment's front surface and orifice.

The container closure device is constructed to permit the flap 13 to fold upward at which time the orifice is unobstructed to permit material to pass through. The container closure device is also constructed to permit the flap to fold over the front surface 5 to completely cover the orifice 11 to thereby obstruct passage of material through the orifice.

In a preferred embodiment, the container closure device includes a locking means for locking the flap 13 over the orifice 11. As shown in the figures, the locking means comprises a tab section 15 which is formed to project into the orifice 11 whereupon the tab section engages the rear surface 7 of the sidewall segment 3. This construction permits the flap 13 to remain in a locked position over orifice 11 until sufficient force is exerted on the flap 13 sufficient to remove the tab section 15 from orifice 11. As would be understood by those skilled in the art, additional locking means for maintaining the flap in a closed position over orifice 11 include the use of hook and pile fasteners, snaps, tape, etc.

Figure 2:
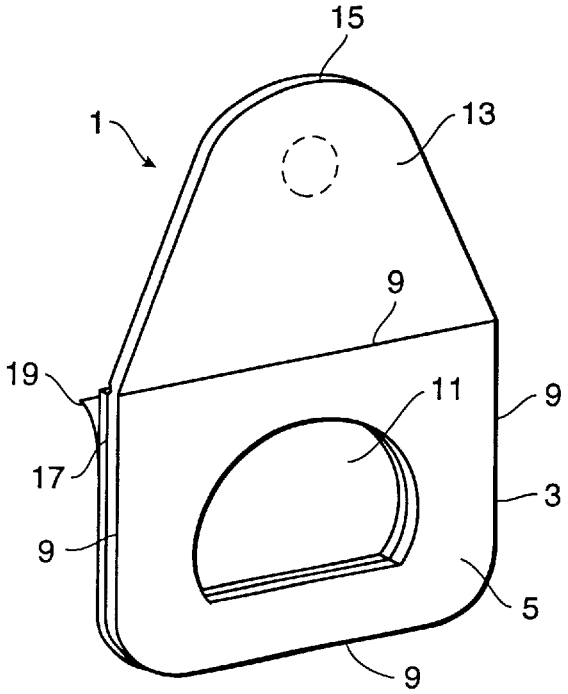
FIG. 2 is a perspective view of the container closure device of the present invention wherein the flap projects upwardly and does not cover the container closure device's orifice.
Figure 3:
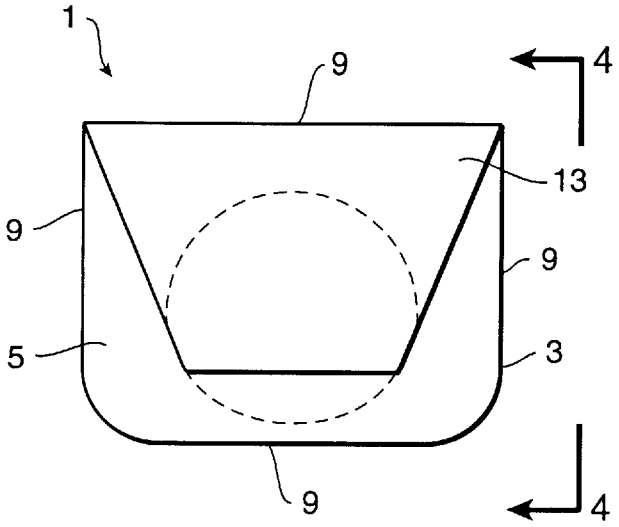
FIG. 3 is a front view of the container closure device showing the flap section projecting into the orifice with the flap in a locked position.
Figure 4:
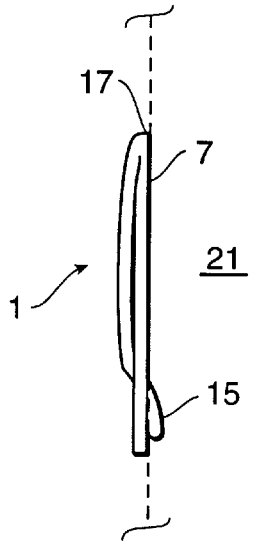
FIG. 4 is a side view of the container closure device of FIG. 3 attached to a container.

In the practice of the present invention, the sidewall segment 3 is attached to a container 21 by an attachment means 17. Again, the attachment means may take many forms known to those skilled in the art. Preferably, the adhesive means is constructed to permit a consumer to attach the sidewall segment 3 of the container closure device 1 to a container 21 of his choosing. In a first preferred embodiment, the attachment means is an adhesive tape or the like having a peel-off paper or plastic backing 19 (as shown in FIG. 2). In practice, the peel-off backing 19 of the adhesive tape is removed leaving an adhesive surface against the rear surface 7 of the sidewall segment 3. The rear surface 7 is then pressed against a container 21. The container's sidewall adjacent to the orifice 11 is then ruptured by the use of a knife, scissors or sharp blade to permit the contents within the container to pass through the rupture and orifice 11 of the container closure device. In a second embodiment, the attachment means 17 is formed of a dry adhesive which obtains adhesive properties upon contact to moisture. Accordingly, upon application of water or the like to the adhesive means 17, a consumer can simply apply the rear surface 7 of the container closure device to a container 21.

As would be understood by those skilled in the art, the container closure device may be manufactured of numerous materials known to those skilled in the art. For example, the container closure device may be manufactured of a stiff paper or cardboard. Furthermore, the container closure device may be manufactured of thermoplastics such as polyethylene, polyvinyl chloride, polypropylene, ABS or the like, or thermosetting plastics such as phenolics or polyesters. In a preferred embodiment, the container closure device is manufactured of any of the plastic materials listed above as they typically do not retain moisture such as a paper or cardboard material and are generally non-reactive to materials which may be contained within the container.

Having described my invention is such terms to enable those skilled in the art to make and use it, and having identified the presently preferred embodiments thereof, i claim:

1. A container closure device for attachment to a container and for selectively dispensing the contents packaged within the container, the container closure device comprising:

a substantially planar sidewall segment having a front surface, a rear surface, a plurality of sides, and an orifice projecting through said sidewall segment from said front surface to said rear surface for permitting the contents to pass therethrough;

a flap extending from one of the sides of said sidewall segment, said flap configured to fold over said front surface of said sidewall segment to substantially cover said orifice thereby obstructing the passage of the contents through said orifice;

a locking means for locking said flap in a closed position over said orifice wherein said locking means is a tab section formed from said flap, said tab section adapted to project through said orifice to engage said rear surface of said sidewall segment to lock said flap in a closed position, said tab section adapted to be capable of being withdrawn from said orifice to permit the passage of contents from within a container to pass through; and attachment means for attaching said rear surface of said sidewall segment to a container.

2. A method of selectively dispensing the contents of a container, the method comprising the steps of:

attaching a container closure device to a container, the container closure device including, a) a substantially planar sidewall segment having a front surface, a rear surface, a plurality of sides, and an orifice projecting through said sidewall segment from said front surface to said rear surface for permitting the contents of the container to pass therethrough, b) a flap extending from one of the sides of said sidewall segment, said flap configured to fold over said front surface of said sidewall segment to substantially cover said orifice thereby obstructing the passage of the contents through said orifice, the flap of the container closure device further including a tab section adapted to project through said orifice to engage said rear surface of said sidewall segment thereby locking said flap in a locked position, said tab section adapted to be capable of being withdrawn from said orifice to permit the passage of the container contents through said orifice, and c) attachment means for attaching said rear surface of said sidewall segment to the outer surface of a container;

rupturing the container's sidewall adjacent to said orifice of said sidewall segment to create a hole in said container;

dispensing the contents of said container through said hole and said orifice;

locking said flap in a closed position over said orifice by projecting said tab section through said orifice to engage said rear surface of said sidewall segment; and obstructing the flow of the container contents through said hole and said orifice by folding said flap over said orifice.

3. A recloseable container for packaging and for selectively dispensing the contents of the container comprising:

a containment means for holding container contents, said containment means including a hole for release of the container contents from within said containment means;

a closure device affixed to the outer surface of said packaging means, said closure device including;

a) a substantially planar sidewall segment having a front surface, a rear surface, a plurality of sides, and an orifice projecting through said sidewall segment from said front surface to said rear surface for permitting container contents to pass therethrough; and b) a flap extending from one of the sides of said sidewall segment, said flap configured to fold over said front surface of said sidewall segment to substantially cover said orifice thereby obstructing the passage of container contents through said orifice, said flap further including a tab section adapted to project through said orifice to engage said rear surface of said sidewall segment thereby locking said flap in a locked position, said tab section adapted to be capable of being withdrawn from said orifice to permit the passage of the container contents through said orifice; and said orifice positioned to engage said hole to permit dispensing of the contents of said container through said hole and said orifice when said flap is not obstructing said orifice, and to permit obstructing the flow of the container contents through said hole and said orifice when said flap is folded over said orifice.

* * * * *